US007967363B2

(12) United States Patent
Schaefer et al.

(10) Patent No.: US 7,967,363 B2
(45) Date of Patent: Jun. 28, 2011

(54) RAIL CAR COVER SYSTEM

(75) Inventors: David J. Schaefer, Yankton, SD (US); Nathan P. Dimmer, Yankton, SD (US); Steven J. Knight, Mission Hill, SD (US); Jerry R. Dimmer, Yankton, SD (US); Michael P. Krajewski, Yankton, SD (US); Kevin J. Kleinsasser, Yankton, SD (US); Carla K. Ewald, Yankton, SD (US)

(73) Assignee: Shorma Company, Springfield, SD (US)

( * ) Notice: Subject to any disclaimer, the term of this patent is extended or adjusted under 35 U.S.C. 154(b) by 0 days.

(21) Appl. No.: 12/877,712

(22) Filed: Sep. 8, 2010

(65) Prior Publication Data

US 2011/0030575 A1 Feb. 10, 2011

Related U.S. Application Data

(63) Continuation of application No. 12/507,210, filed on Jul. 22, 2009, now Pat. No. 7,823,515.

(60) Provisional application No. 61/088,037, filed on Aug. 12, 2008.

(51) Int. Cl.
*B60P 7/02* (2006.01)

(52) U.S. Cl. ..... 296/100.06

(58) Field of Classification Search ..... 296/100.06, 296/100.09, 97.5, 100.01, 146.9; 220/4.23, 220/908; 49/504; 105/241.2, 247, 248, 250, 105/377.01, 378, 377.02, 377.05, 377.06, 105/377.11

See application file for complete search history.

(56) References Cited

U.S. PATENT DOCUMENTS 1,847,132 A 3/1932 Morrow
2,408,132 A * 9/1946 Weeks ..... 296/223
2,629,339 A * 2/1953 Kovachick ..... 105/377.06
3,009,426 A 11/1961 Nampa (Continued)

FOREIGN PATENT DOCUMENTS

EP 0011195 5/1980

(Continued)

OTHER PUBLICATIONS http://www.aeroindustries.com/products/thelid/index.cfm Jun. 10, 2008.

(Continued)

*Primary Examiner* — Kiran B. Patel
(74) *Attorney, Agent, or Firm* — Dicke, Billig & Czaja, PLLC

(57) ABSTRACT

A rail car cover system including a rail car, a first cover section and a second cover section. The rail car has an opening. The first cover section is operably attached to the rail car. The first cover section includes a first corner hinge assembly, a first intermediate hinge assembly and a first cover material. The first corner hinge assembly is attached to the first cover material. The first intermediate hinge assembly is slidable with respect to the first cover material. The second cover section is operably attached to the rail car. The second cover section includes a second corner hinge assembly, a second intermediate hinge assembly and a second cover material. The second corner hinge assembly is attached to the second cover material. The second intermediate hinge assembly is slidable with respect to the second cover material. The first cover section and the second cover section are both movable between a closed configuration and an open configuration. When in the closed configuration, the first cover section and the second cover section substantially cover the opening.

24 Claims, 8 Drawing Sheets

U.S. PATENT DOCUMENTS

| | | | | | |
|---|---|---|---|---|---|
| 3,069,199 | A | * | 12/1962 | Reardon et al. | 296/100.07 |
| 3,106,900 | A | * | 10/1963 | Gallo et al. | 105/355 |
| 3,169,492 | A | | 2/1965 | Stiefel et al. | |
| 3,503,341 | A | | 3/1970 | Widell et al. | |
| 3,707,919 | A | * | 1/1973 | Adler | 105/377.03 |
| 3,736,883 | A | * | 6/1973 | Yang et al. | 105/377.05 |
| 3,831,792 | A | * | 8/1974 | Waterman et al. | 414/373 |
| 3,995,890 | A | * | 12/1976 | Fletcher | 296/10 |
| 4,302,044 | A | * | 11/1981 | Sims | 296/186.4 |
| 4,542,931 | A | * | 9/1985 | Walker, Jr. | 296/100.1 |
| 4,627,658 | A | * | 12/1986 | Vold et al. | 296/100.1 |
| 4,682,811 | A | * | 7/1987 | Ooguro | 296/186.4 |
| 4,767,152 | A | * | 8/1988 | Stluka et al. | 296/100.1 |
| 4,771,940 | A | * | 9/1988 | Taylor | 220/832 |
| 4,832,394 | A | * | 5/1989 | Macomber | 296/100.06 |
| 5,088,616 | A | * | 2/1992 | Susko et al. | 220/844 |
| 5,542,734 | A | * | 8/1996 | Burchett et al. | 296/100.1 |
| 5,988,732 | A | * | 11/1999 | Schouten | 296/186.4 |
| 6,019,242 | A | * | 2/2000 | Wysocki et al. | 220/571 |
| 6,042,175 | A | * | 3/2000 | Williams | 296/185.1 |
| 6,176,540 | B1 | * | 1/2001 | Whittaker | 296/100.02 |
| 6,227,608 | B1 | * | 5/2001 | Hoyne | 296/183.1 |
| 6,352,036 | B1 | | 3/2002 | Early | |
| 6,402,224 | B1 | * | 6/2002 | Monaco et al. | 296/100.1 |
| 6,435,594 | B1 | * | 8/2002 | Ekonen et al. | 296/100.09 |
| 6,598,930 | B1 | * | 7/2003 | Tilton | 296/100.06 |
| 6,607,229 | B1 | * | 8/2003 | McIntosh | 296/26.06 |
| 6,663,160 | B2 | * | 12/2003 | Yarbrough et al. | 296/100.06 |
| 6,799,784 | B2 | * | 10/2004 | Rios | 296/26.06 |
| 6,983,975 | B2 | | 1/2006 | Morrow | |
| 7,246,839 | B1 | * | 7/2007 | Nyberg | 296/100.06 |
| 7,384,089 | B1 | * | 6/2008 | Ablang et al. | 296/100.08 |
| 7,878,124 | B2 | | 2/2011 | Low et al. | |

FOREIGN PATENT DOCUMENTS

| | | |
|---|---|---|
| EP | 0308607 | 3/1989 |
| EP | 0547448 | 6/1993 |
| GB | 2101548 | 1/1983 |
| GB | 2236290 | 4/1991 |

OTHER PUBLICATIONS http://www.youtube.com/watch?v=IO6HazKljL0 Jun. 10, 2008.

http://mountaintarp.com/Merchang2/merchant,mvc?Screen=CTGY&Category_Code=side...Jun. 10, 2008.

* cited by examiner

RAIL CAR COVER SYSTEM

REFERENCE TO RELATED APPLICATION

This application claims priority to U.S. application Ser. No. 12/507,210, which was filed on Jul. 22, 2009, and U.S. Provisional Application No. 61/088,039, which was filed on Aug. 12, 2008, the contents of which are incorporated herein by reference.

FIELD OF THE INVENTION

The invention relates generally to enclosures for vehicles. More particularly, the invention relates to enclosures for rail cars.

BACKGROUND OF THE INVENTION

When transporting relatively large quantities of many types of products, it is typically more cost effective to transport the products in bulk where the products are placed into the vehicle that is utilized to transport the product.

Depending on various factors such as the quantity of products being shipped and the distance over which the products are being shipped, the products may be transported in a rail car, a truck or a trailer. To facilitate placing the product into and/or out of the transport vehicle, the transport vehicle may include an open top.

When transporting various types of products in open top vehicles, it is possible for air movement over the product to cause a portion of the product to be blown out of the transport vehicle. Even when a relatively small portion of material is blown out of the transport vehicle, this lost material may pose problems.

For example, when coal is being hauled in open top rail cars, relatively small coal particles or dust may be blown out of the rail cars from the flow of air over the coal as the rail cars move as well as from ambient winds. Even though the amount of coal that is blown out of a particular rail car may be relatively small, the rail cars are typically moved in relatively long trains that may each have over 100 rail cars. In addition, in certain areas, many trains may travel through the same area numerous times each day, which could result in significant accumulation of the material blown out of the rail car over extended periods of time.

When the coal particles accumulate proximate to the railroad tracks over which the trains pass, the quality of the rail bed may be degraded. For example, the ability of the rail bed to properly drain water from rain or melting snow is diminished which can lead to the saturation of the rail bed and subsoil beneath the tracks. This could lead to potentially dangerous situations such as derailment of rail cars.

There have been various attempts to reduce coal particles escaping from the rail cars and contaminating the roadbed and the surrounding environment. Unfortunately, there are numerous barriers that exclude the use of a tarp or previously known mechanical closures. One example is that sometimes coal is loaded and unloaded from rail cars while they are moving. Another example is that some rail cars are completely inverted during the unloading process and prior cover designs interfere with the clamps or dumping process.

One dust controlling technique involves spraying water on top of the coal. While water initially works well, water tends to evaporate relatively fast because of the air flow over the coal pile as the rail car moves. Additionally, water tends to be in relatively short supply in some areas where coal is mined.

Another technique involves spraying water soluble chemicals over the coal to create a wind resistant crust. While these materials can last much longer than water, they are considerably more expensive than water and must be mixed with water, which can be in relatively short supply in some regions where coal is mined as noted above.

During transit, coal tends to shift which can decrease the effectiveness of the wind resistant crust. There are also potential issues relating to the water soluble materials being compatible with the power plants in which the coal is burned.

It has also been proposed to place a rigid cover over the rail car. Prior to the coal loading or unloading process, the rail car rigid cover is lifted off of the rail car. Once the process is completed, the rail car rigid cover is replaced onto the rail car.

Because of the relatively large size of the rail car rigid cover, there are challenges associated with handling the rail car rigid cover during the coal loading process at the mine and the unloading process at the power plants. Because of the fact that the rail car rigid cover handling equipment may be relatively large and the process cumbersome or in the case of bottom dump unloading it may be possible that the rail car rigid cover can remain in the closed position on the rail car during the dumping process if it has adequate venting capabilities.

SUMMARY OF THE INVENTION

An embodiment of the invention is directed to a rail car cover system that is used in conjunction with a rail car having an opening. The rail car cover system includes a first cover section and a second cover section.

The first cover section is operably attached to the rail car. The first cover section includes a first corner hinge assembly, a first intermediate hinge assembly and a first cover material. The first corner hinge assembly is attached to the first cover material. The first intermediate hinge assembly is slidable with respect to the first cover material.

The second cover section is operably attached to the rail car. The second cover section includes a second corner hinge assembly, a second intermediate hinge assembly and a second cover material. The second corner hinge assembly is attached to the second cover material. The second intermediate hinge assembly is slidable with respect to the second cover material. The first cover section and the second cover section are both movable between a closed configuration and an open configuration. When in the closed configuration, the first cover section and the second cover section substantially cover the opening.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE PREFERRED EMBODIMENTS

Figure 1:
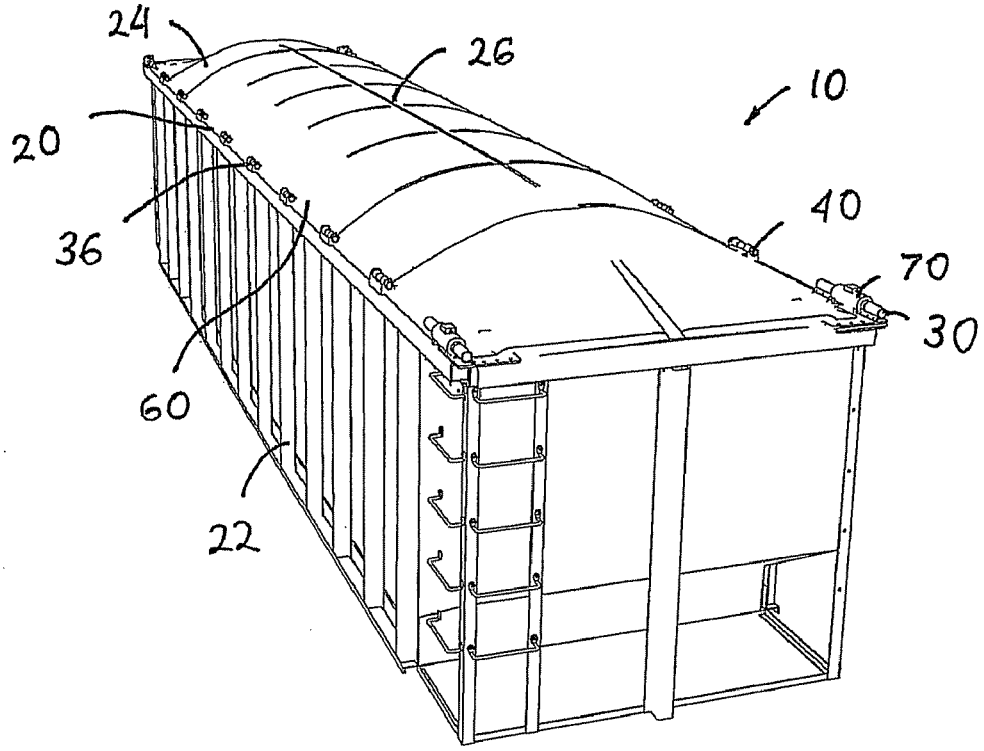
FIG. 1 is a perspective view of a rail car cover system according to an embodiment of the invention where the rail car cover system is in a closed configuration.
Figure 2:
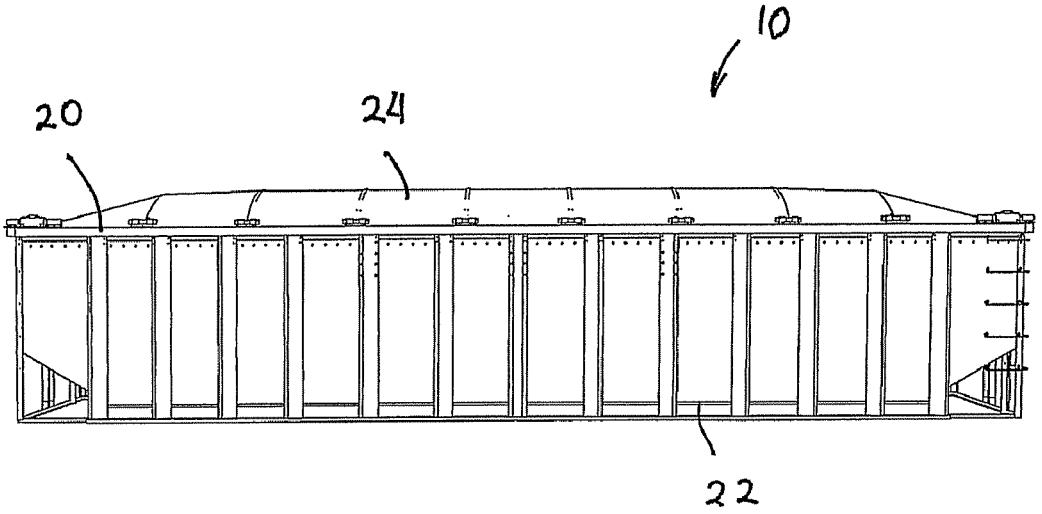
FIG. 2 is a side view of the rail car cover system in the closed configuration.

An embodiment of the invention is directed to a rail car cover system for an open top vehicle such as a rail car, as illustrated at 10 in the figures. The rail car cover system 10 substantially covers an upper end 20 of a rail car 22 when in the closed configuration.

The rail car 22 does not illustrate wheel assemblies because a variety of types of wheel assemblies such as are suited for use on rails or conventional roads may be used in conjunction with the rail car cover system 10 of the current invention.

One advantage of the rail car cover system 10 is that the rail car cover system 10 provides near complete coal dust mitigation in a highly reliable manner. While the concepts of the invention are particularly suited for use in conjunction with rail cars 22 that carry coal, a person of skill in the art will appreciate that other materials may be transported in the rail car 22. The rail car cover system 10 can be adapted for use in conjunction with rail cars 22 having a variety of heights, lengths and widths.

Another advantage of the rail car cover system 10 is that it enhances the aerodynamics of the rail car 22, which may be more important when the rail car 22 is moving empty. Using the rail car cover system 10 in conjunction with the rail car 22 could thereby enhance the fuel efficiency of the train by up to about 20 percent.

Yet another advantage of the rail car cover system 10 is that it reduces the potential of precipitation entering the rail car 22 and thereby solidifying the coal in the rail car 22 in freezing temperatures. When this occurs the rail car 22 would need to be heated before it is possible to unload the coal from the rail car 22.

In certain embodiments, the rail car cover system 10 includes a first cover section 24 and a second cover section 26. The first cover section 24 and the second cover section 26 are operably attached to opposite sides of the rail car 22. In certain embodiments, the first cover section 24 and the second cover section 26 may have a substantially identical configuration.

In other embodiments, the rail car cover system 10 may include a single cover section or different sizes. It is also possible to fabricate the rail car cover system 10 having a length and a width that is less than the length and/or width of the rail car 22 to which it is attached.

Figure 4:
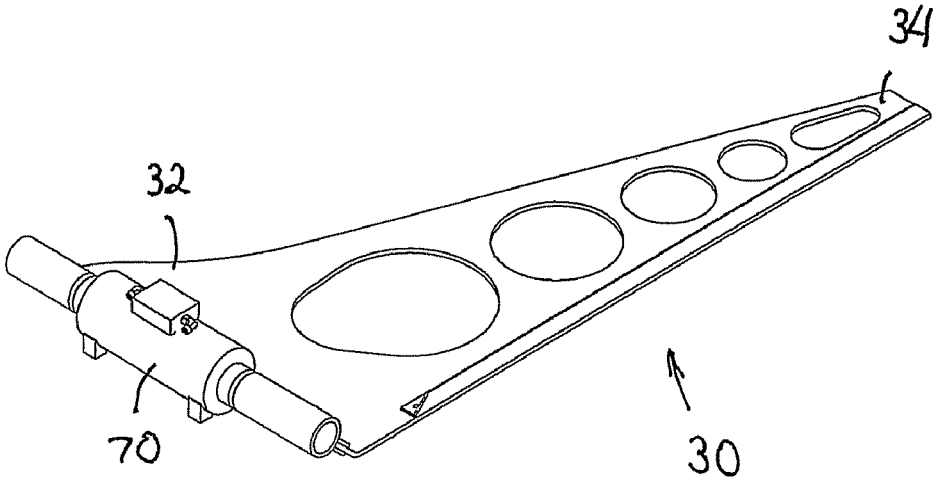
FIG. 4 is a perspective view of a corner hinge assembly for the rail car cover system.

The first cover section 24 and the second cover section 26 may each have at least one corner hinge assembly 30, such as is illustrated in FIG. 4. While the corner hinge assembly 30 may be substantially flat, forming the corner hinge assembly 30 with other configurations such as a U-shape cross-section may enhance the strength of the corner hinge assembly 30. However, the corner hinge assembly 30 should be relatively flat to allow the rail car 22 to slide into a relatively small clearance between the rail car 22 and a spill girder of a rotary dumper (not shown).

The corner hinge assembly 30 may have a substantially linear configuration so that the corner hinge assembly may be substantially adjacent to an upper surface on the end of the rail car 22 in the closed position. This configuration restricts air from flowing under the cover system 10 when the rail car 22 is moving.

The corner hinge assembly 30 may be substantially adjacent to the outer surface of the side of the rail car 22 in the open position. This configuration allows either cover section 24, 26 to slide into extremely small clearance between the spill girder and the side of the rail car 22 as the rail car 22 enters the barrel of the rotary dumper. The corner hinge assembly 30 may be fabricated from a rigid material such as steel that resists deformation and bending.

In certain embodiments, the corner hinge assembly 30 may be operably attached to a side of the rail car 22 proximate an upper edge thereof using a hinge mechanism 36. As is described in more detail below, the hinge mechanism 36 may enable the corner hinge assembly 30 to pivot over a range of more than 180° and, in certain embodiments, up to about 270° such that the corner hinge assembly 30 may be in a generally horizontal position for covering the rail car 22 as well as in a generally vertical position where the corner hinge assembly 30 is adjacent to a side of the rail car 22 to facilitate loading and/or unloading of the rail car 22.

The hinge ribs 40 in between the corner hinge assemblies have two functions. The hinge ribs 40 support fiberglass ribs that sandwich and support the cover. The hinge ribs 40 also allow the whole assembly to rotate with the arms when the rotary actuator is moved between open and closed positions.

Most of the hinge ribs are intermediate hinges 36. These intermediate hinges 36 hold the fiberglass at a slightly higher angle when in the closed position. A first hinge rib from each corner is a transitional hinge 40. The transitional hinge 40 holds the fiberglass at a lower angle in the closed position. This configuration allows the cover to smoothly transition from the arched shape in the middle of the rail car 22 to a flat profile at the end arms. The transitional hinges 40 may have shorter and stiffer fiberglass ribs that allow for less curvature of the cover to thereby transition to the relatively flat end arms.

In certain embodiments, the corner hinge assembly 30 may have a width that is greater proximate a proximal end 32 than proximate a distal end 34. Forming the corner hinge assembly 30 with this shape may compensate for the greater forces that are placed on the corner hinge assembly 30 proximate the proximal end 32.

The geometry of the corner hinge assembly 30 may be such that its axis is skewed. This configuration allows the end arms to be plumb and perpendicular in the open position, which ensures that the cover 10 will be flat and flush against the outside of the rail car. As the corner hinge assemblies 30 rotate to the closed position, the corner hinge assemblies will angle in slightly allowing the taut cover to follow the contours of the coal pile down the center of the rail car while remaining straight along the hinge line.

While it is possible to connect the hinges 36 together that extend along the length of the rail car 22, an advantage of not connecting the hinges is that the different hinges may pivot at different rates such as in response to a force being placed on one of the hinge assemblies. Using separate hinges 36 also allows for more axial misalignment on rail cars that may not be straight. Separate hinges 36 allow for different amounts of linear axial movement of the cover due to tensioning and thermal expansion.

Figure 5:
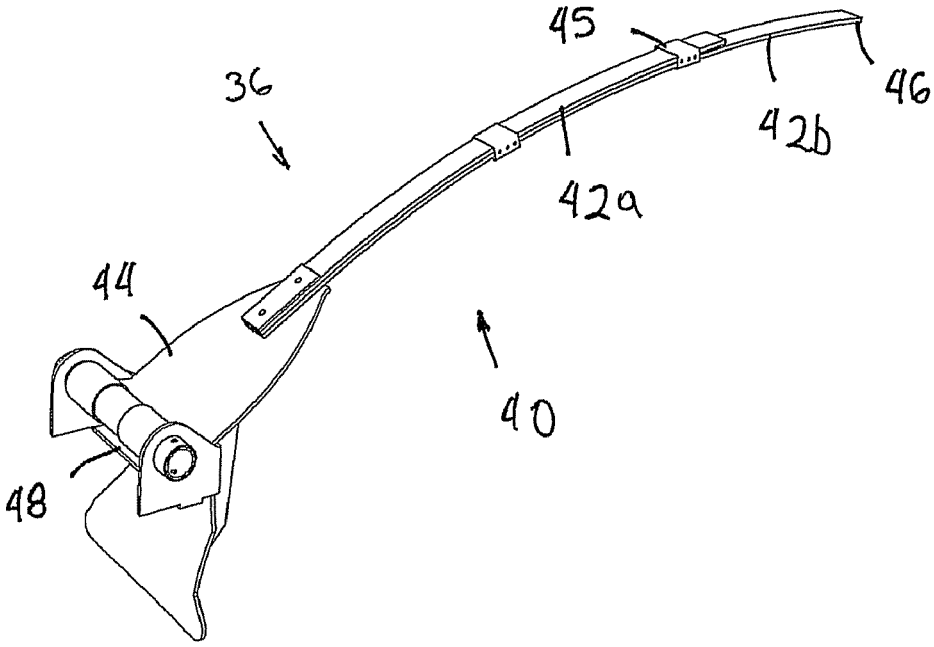
FIG. 5 is a perspective view of an intermediate hinge assembly for the rail car cover system.
Figure 6:
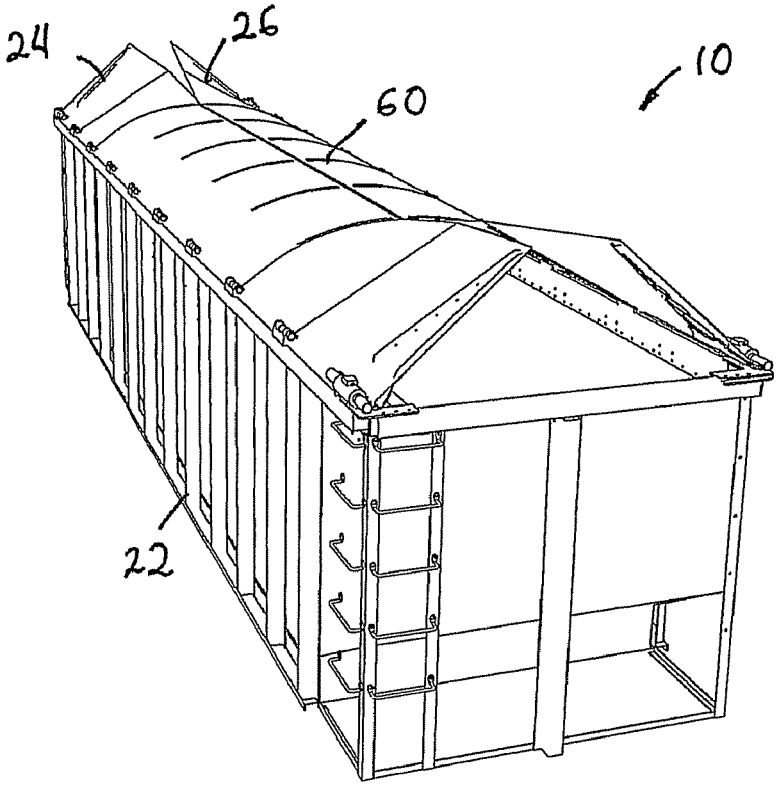
FIGS. 6-13 are perspective views of the rail car cover system moving from the closed configuration to an open configuration.
Figure 7:
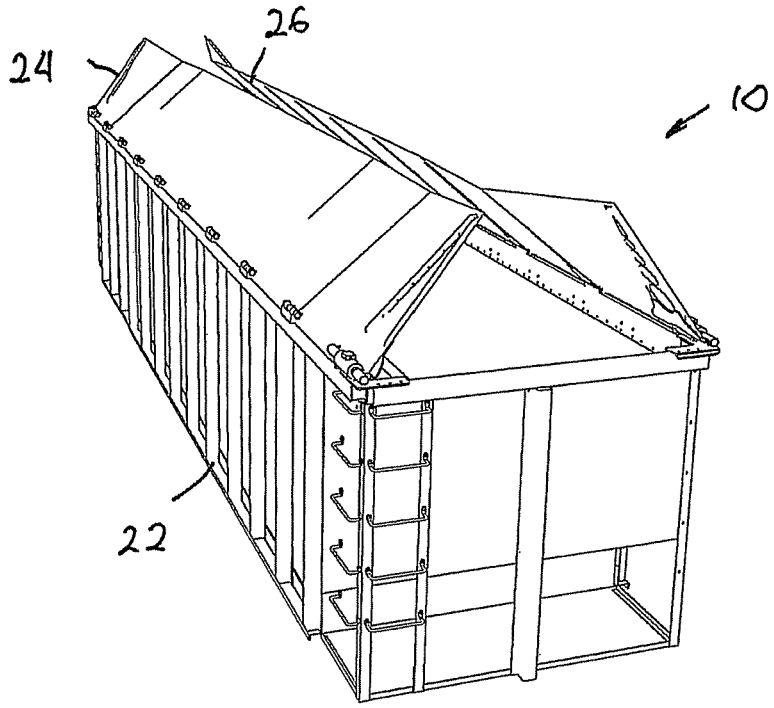
Figure 8:
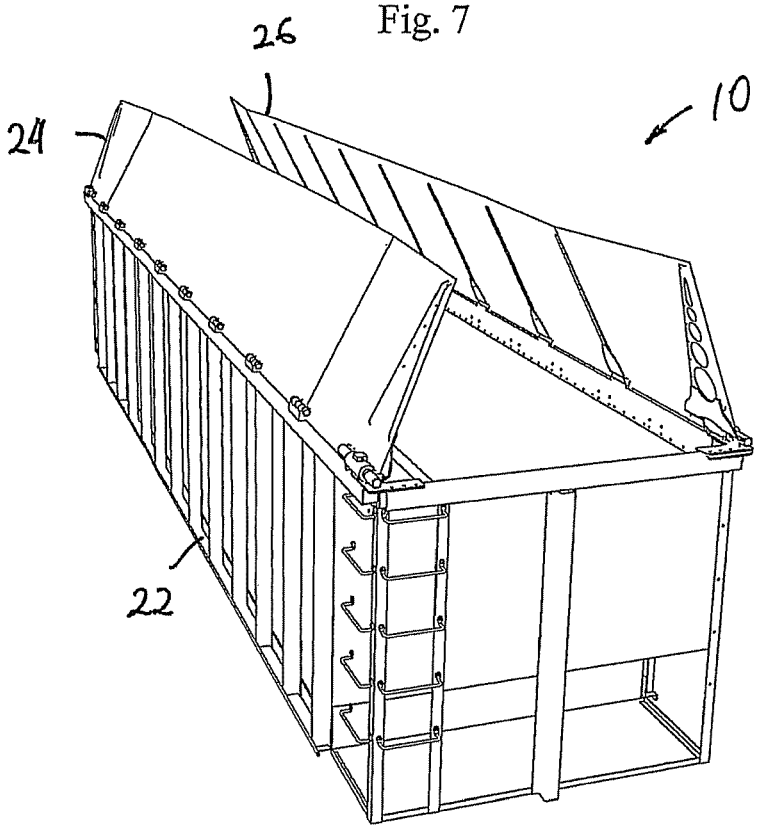
Figure 9:
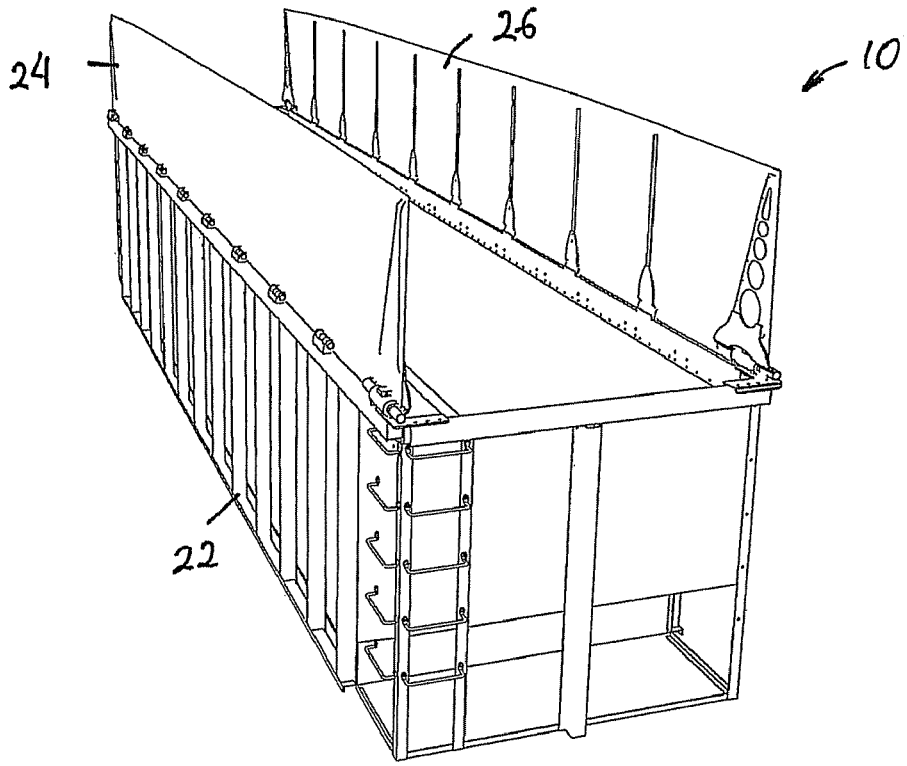
Figure 10:
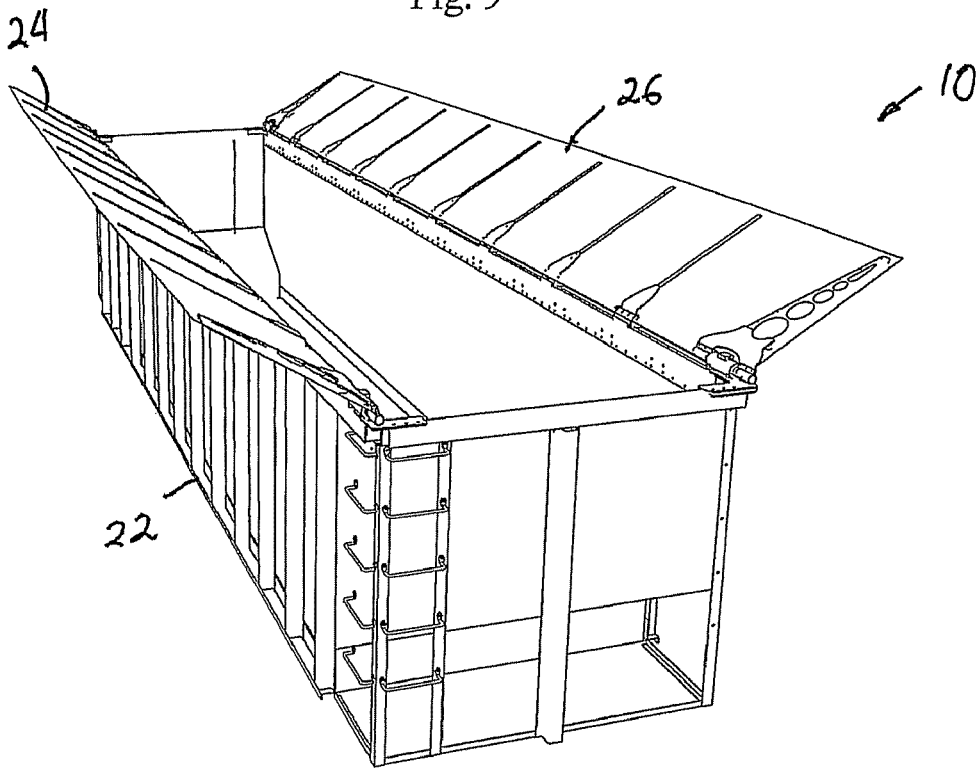
Figure 11:
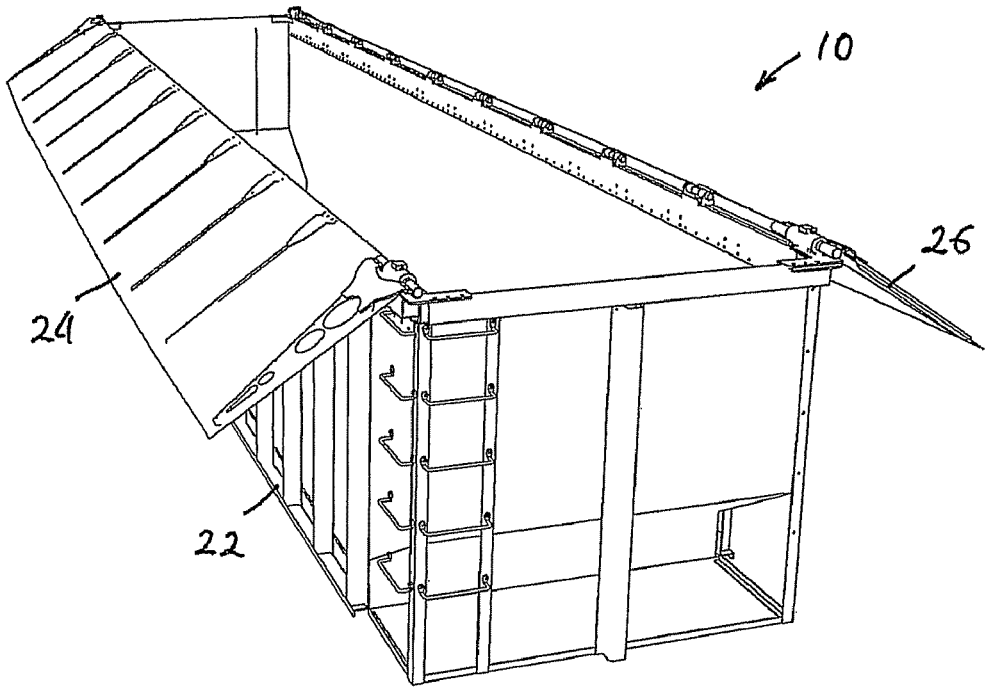
Figure 12:
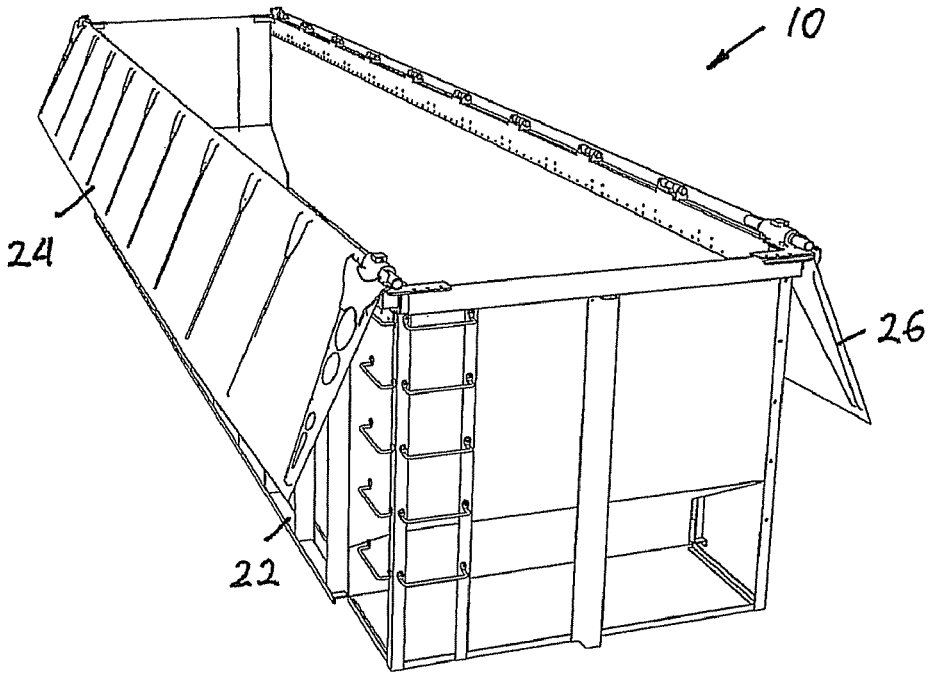
Figure 13:
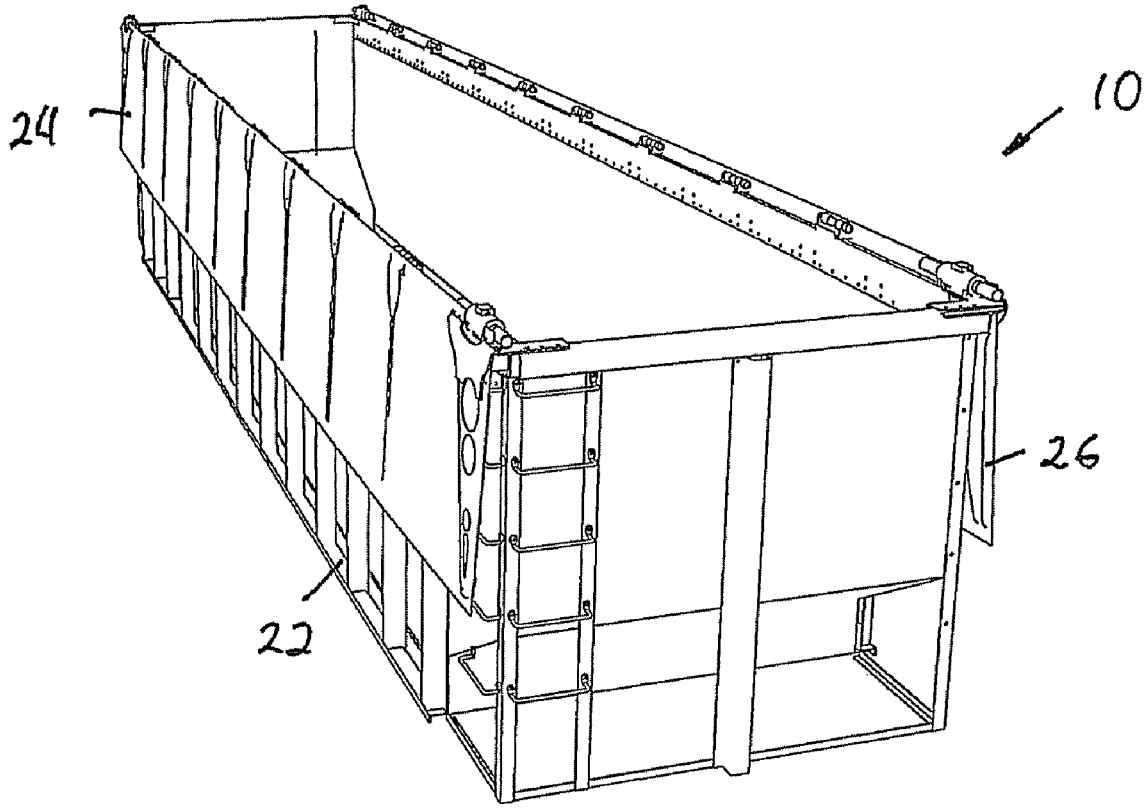

At least one intermediate hinge assembly 36 may also be provided, as illustrated in FIG. 5. In certain embodiments, 2-10 intermediate hinge assemblies 36 are utilized on each side of the first cover section 24 and the second cover section 26.

The fiberglass ribs flexing to convex slope is done to better fit the shape of the coal pile and to provide a smooth transition from one cover side to the other as it arcs over the rail car and to shed precipitation. The convex shape also gives the cover material some structural integrity that allows the cover material to span between adjacent ribs while minimizing sagging.

It is possible for the transitional and intermediate hinge assembly 36, 40 to have a substantially linear configuration or a convex configuration. In addition to increasing the volume of product that may be transported in the rail car, forming the intermediate hinge assembly 36 with a convex configuration may also increase the strength of the intermediate hinge assembly 36.

In certain embodiments, the intermediate hinge assembly 36 is fabricated from a flexible material such as fiberglass 42 that is substantially straight when the cover system 10 is in the open position and is curved to a convex configuration when the cover system 10 is in the closed position.

While it is illustrated that the corner hinge assembly 30 and the intermediate hinge assembly 36 have different shapes, it is possible for the corner hinge assembly 30 and the intermediate hinge assembly 36 to have similar shapes. In certain embodiments, the intermediate and transitional hinge assemblies 36, 40 may have a substantially planar cross section or other shaped profiles.

In certain embodiments, the intermediate hinge assembly 36 may be formed from more than one elongated member 42 that is operably attached together at one or more locations. Additionally, in certain embodiments, the intermediate hinge assembly 36 may have a width that is greater proximate a proximal end 44 than proximate a distal end 46.

In other embodiments, the intermediate hinge assembly 36 includes a first elongated member 42*a*, a second elongated member 42*b* and a connector 45. A proximal end of the first elongated member 42*a* and a proximal end of the second elongated member 42*b* may both be attached to the hinge mechanism 48.

The first elongated member 42*a* and the second elongated member 42*b* may each have a length that is approximately equal. In other embodiments, the length of the second elongated member 42*b* may be longer than the length of the first elongated member 42*a*.

The first elongated member 42*a* may be positioned adjacent to an upper surface of the flexible material 60. The second elongated member 42*b* may be positioned adjacent to a lower surface of the flexible material 60. In certain embodiments, the second elongated member 42*b* is positioned at least partially above the first elongated member 42*a* so that the first elongated member 42*a* is laterally aligned with the second elongated member 42*b*.

The connector 45 may engage the first elongated member 42*a* and the second elongated member 42*b* at a location that is spaced apart from the hinge mechanism 48. In certain embodiments, the connector 45 may be positioned proximate a distal end of at least one of the first elongated member 42*a* and the second elongated member 42*b*.

However, the connector 45 should not be positioned too close to the distal ends of the first elongated member 42*a* and the second elongated member 42*b* such that the connector 45 could slide beyond the distal end of the first elongated member 42*a* or the second elongated member 42*b*, as that would cause the components of the intermediate hinge to disengage from each other, which could result in damage to the cover system.

In certain embodiments, an aperture 47 may be formed in the flexible material 60 having a length and a width that are greater than a length and a width of the connector 45. The aperture 47 facilitates maintaining the first elongated member 42*a* and the second elongated member 42*b* in a desired positioned with respect to each other using the connector 45.

When the first elongated member 42*a* is positioned adjacent to the upper surface of the flexible material 60 and the second elongated member 42*b* is positioned adjacent to the lower surface of the flexible material 60, the connector 45 is extended through the aperture 47 and at least partially around the first elongated member 42*a* and the second elongated member 42*b*. In certain embodiments, the connector 45 extends substantially around the first elongated member 42*a* and the second elongated member 42*b*, as illustrated in FIG. 5

This configuration retains the connector 45 on the first elongated member 42*a* and the second elongated member 42*b* while allowing the connector 45 to slide with respect to at least one of the first elongated member 42*a* and the second elongated member 42*b*. In certain embodiments, the connector 45 is slidable with respect to both the first elongated member 42*a* and the second elongated member 42*b*.

This configuration also permits the first elongated member 42*a* and the second elongated member 42*b* to flex such as when the first cover section 24 and the second cover section 26 move between the open configuration and the closed configuration while minimizing the forces that are placed on the components of the cover system, which could cause degradation of the components of the cover system.

The connector 45 may have a generally square or rectangular profile so that a width of the connector 45 is slightly larger than a width of the first elongated member 42*a* and the second elongated member 42*b*. The connector 45 may be formed with a height that is slightly larger than a combined height of the first elongated member 42*a*, the second elongated member 42*a* and the flexible material 60.

Forming the connector 45 with the preceding characteristics facilitates sliding of the connector 45 with respect to the first elongated member 42*a*, the second elongated member 42*b* and the flexible material 60 while minimizing the potential of the connector 45 becoming stuck in a stationary position with respect to the preceding components.

In certain embodiments, the intermediate hinge assembly 36 may be operably attached to a side of the rail car 22 proximate an upper edge thereof using a hinge mechanism 48. As is described in more detail below, the hinge mechanism 48 may enable the intermediate hinge assembly 36 to pivot over a range of more than 180° and, in certain embodiments, up to about 270° such that the intermediate hinge assembly 36 may be in a generally horizontal position for covering the rail car 22 as well as in a generally vertical position where the intermediate hinge assembly 36 is adjacent to a side of the rail car 22 to facilitate loading and/or unloading of the rail car 22.

In certain embodiments, the cover system 10 may include a lower frame member (not shown) that facilitates attachment of the corner hinge assembly 30 and the intermediate hinge assembly 40 to the rail car 22.

Similarly, in certain embodiments, the cover system 10 may include an upper frame member (not shown) that extends substantially along a length of the cover system 10 between the corner hinge assembly 30 and the intermediate hinge assembly 36 or between the intermediate hinge assemblies 36 opposite to where the cover system 10 attaches to the rail car 22.

The corner hinge assembly 30 and the intermediate hinge assembly 36 may be substantially covered by a flexible material 60 such as a tarp or belting. In certain embodiments, the flexible material 60 may be waterproof. Covering the corner hinge assembly 30 and the intermediate hinge assembly 36 with the flexible material 60 enables the cover system 10 to bend such as when coal extends above an upper edge of the rail car 22. Additionally, the flexible material 60 and the intermediate hinge assemblies 36 can deflect in response to the low pressures caused as the coal is discharged from the bottom of the rail car 22.

Figure 14:
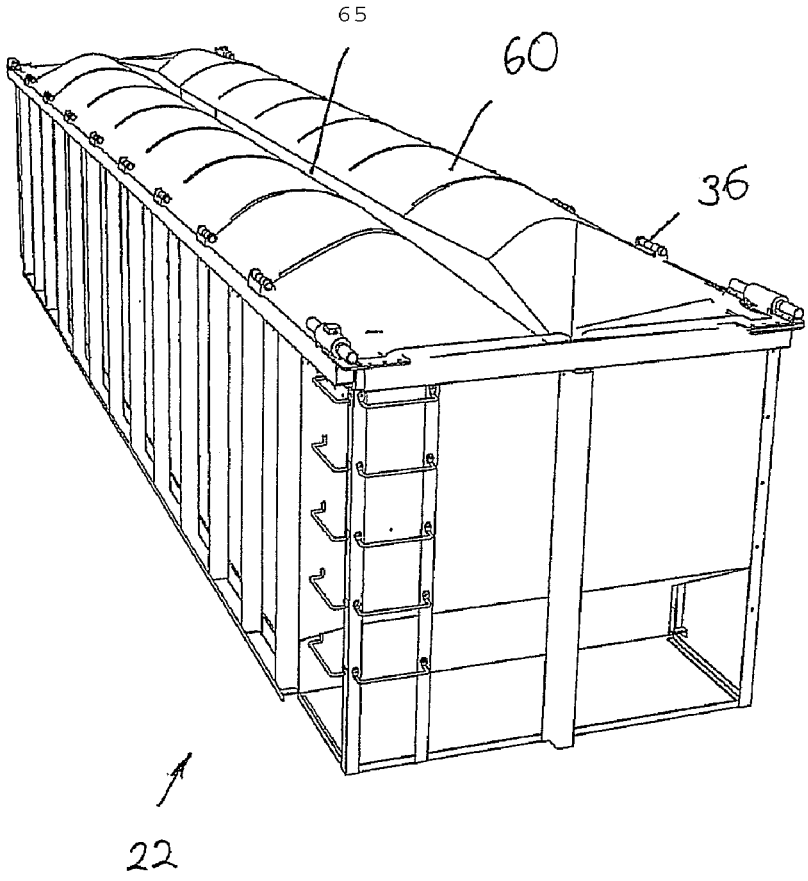
FIG. 14 is a perspective view of the rail car cover system moving to a deflected configuration as product is discharged from a lower end of the rail car.

Additionally, the flexible material 60 and the intermediate hinge assemblies 36 can deflect in response to the low pressures caused as the product such as coal or grain is discharged from the bottom of the rail car 22, as illustrated in FIG. 14. A gap is thereby created between the distal ends of the first cover section 24 and the second cover section 26. This gap allows air to enter the interior of the rail car to compensate for the vacuum created by the discharge of the product from the bottom of the rail car. A size of the gap may be affected by a variety of factors such as the rate at which the product is being discharged from rail car.

This deflection of the cover system may be facilitated by bending of the first elongated section 42*a* and the second elongated section 42*b* from the closed configuration illustrated in FIG. 1 to a deflected configuration illustrated in FIG. 14. When in the closed configuration, the first elongated member 42*a* and the second elongated member 42*b* may have a generally convex shape. When in the deflected configuration, the first elgonated member 42*a* and the second elongated member 42*b* may have a greater convex shape than when in the closed configuration. Alternatively, the first elongated member 42*a* and the second elongated member 42*b* may have a generally concave configuration.

Once the discharging is completed or the rate of discharge has slowed such that the downward force on the cover system is reduced, the intermediate first cover section 24 and the second cover section 26 return to the closed configuration illustrated in FIG. 1. Movement of the first cover section 24 and the second cover section 26 to the closed configuration may be in response to the force of the first elongated member 42*a* and the second elongated member 42*b*.

Movement of the first cover section 24 and the second cover section 26 between the open and closed configurations may be accomplished using a mechanical assist such as a hydraulic actuator 70. Depending on the size of the rail car cover system 10, it is also possible to manually move the first cover section 24 and the second cover section 26 between the open and closed configurations. Another method is to use the train movement.

At least one of the hydraulic actuators 70 is placed along each side of the rail car. In certain embodiments, one of the hydraulic actuators 70 is an integral part of the corner hinge assembly 30 while in other embodiments, the hydraulic actuator 70 is placed adjacent to each of the corner hinge assemblies 30. The hydraulic actuator 70 is selected with a sufficient capacity to move the first cover section 24 and the second cover section 26 between the open and closed positions. The hydraulic actuator 70 may also be mounted inside of the rail car 22. A mounting bracket is used to attach the hydraulic actuator 70 to the rail car 22.

In certain embodiments, the operation of the rail car cover system 10 is controlled with DC hydraulic pump that is operably connected to the hydraulic actuator 70. Through the use of hydraulic actuators 70 to control the operation of the rail car cover system 10, the rail car cover system 10 operates in a highly reliable manner independent of external factors such as the ambient temperature and the presence of precipitation. The hydraulic pump may be reversible for opening and closing of the cover system 10. Alternatively, a directional valve may be utilized in conjunction with a single direction hydraulic pump.

A single hydraulic pump may be utilized to simultaneously power the operation of the hydraulic actuators 70 on the cover system 10. Alternatively, it is possible to independently operate each of the hydraulic actuators 70.

Through the use of counterbalance valves on the hydraulic actuators 70 to control the operation of the rail car cover system 10, the rail car cover system 10 is locked in a stationary position when the hydraulic actuator 70 stops. The counterbalance valves also provide smooth stable motion when dealing with an over-center load. For example, this configuration retains the rail car cover system 10 in the open position when loading and unloading the rail car 22 and in the closed position when the rail car 22 is moving when loaded. This system thereby reduces the potential of damage to the components of the rail car cover system 10 caused by the rail car cover system 10 inadvertently moving from either the open position or the closed position.

Figure 3:
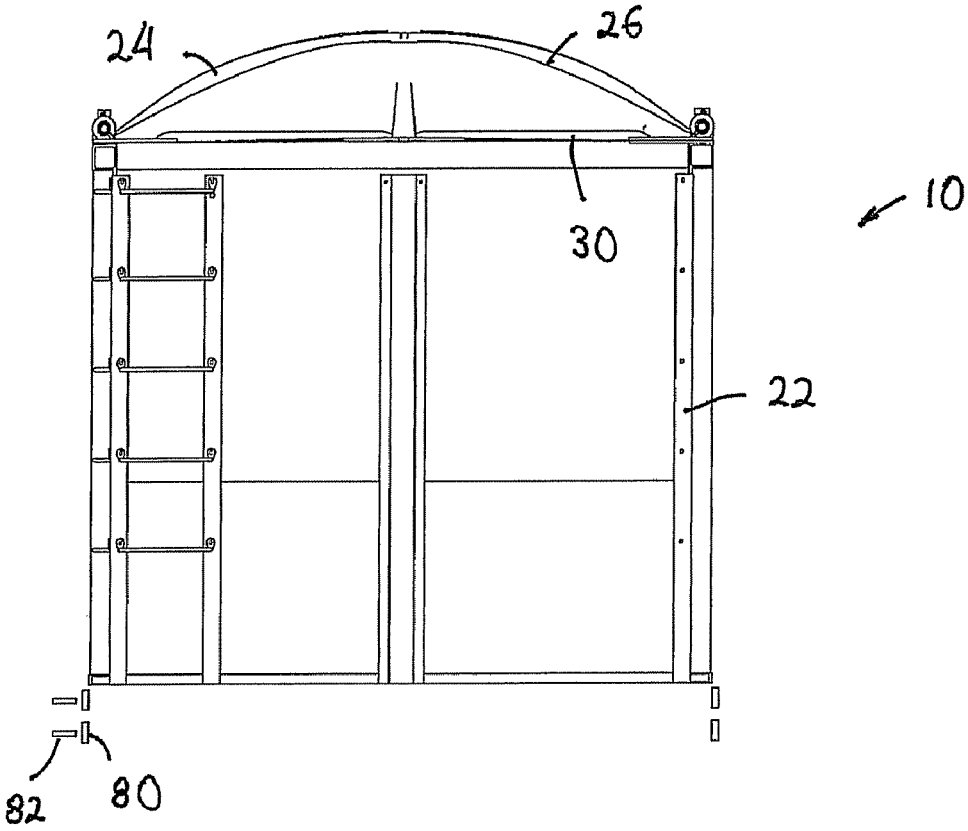
FIG. 3 is an end view of the rail car cover system in the closed configuration.

The DC hydraulic pump could receive power from a pair of electric contact paddles 80 mounted on the rail car 22 that interact with an additional pair of power rails 82 that are provided adjacent to the railroad tracks over which the rail car 22 moves, as illustrated in FIG. 3. This system is similar to the system that is used to control the opening and closing of gates on bottom dump rail cars. Batteries with solar chargers may also be used.

The electric contact paddles 80 may be retractable and spring loaded to not only prevent damage to the contact paddles 80 but also to ensure good electrical contact between the contact paddles 80 and the power rails 82 that are utilized to power the operation of the hydraulic actuator 70.

In certain embodiments, the contact paddles 80 are provided on one side of the rail car 22. In other embodiments, the contact paddles 80 are mounted on both sides of the rail car 22. This later configuration enables the rail car cover system 10 to be operated irrespective of the direction in which the rail car 22 is traveling. In other embodiments, the power rails may be mounted along side of, above or below the rail car.

The power rails 82 are connected to positive and negative terminals of a DC power supply. The polarity of the power rails 82 will determine if the covers 10 are opening or closing. The length of the power rails 82 is determined by how fast the train is moving and how long the hydraulic pump needs to run to open and close the cover sections 24, 26. Since the train speed may vary slightly when loading the rail cars 22, the power rails 82 need to be long enough to accommodate the fastest speed at which the train will move.

The contact paddles 80 may be mounted on the rail car 22 so that they will come into sliding contact with a pair of stationary power rails 82 as the rail car moves on the track. The interface between the rail car 22 and the loading/unloading facility is dimensionally stable and has low forces involved. This configuration is thereby reliable to operate in a variety of conditions over long periods of time.

As the rail cars 22 enter the loading/unloading facility, the rail cars 22 will initially go by first pair of power rails 82 that will run the hydraulic pump in a first direction to open the cover sections 24, 26, as illustrated in FIGS. 6-13. Thereafter, the rail cars 22 will go by a second pair of power rails 82 with an opposite polarity that will run the hydraulic pump in an opposite direction to close the cover sections 24, 26.

Other techniques for activating the cover system include GPS activation, proximity switches and laser beams.

This situation may cause the hydraulic pump to operate longer than is needed to open or close the cover sections 24, 26. A kick down relief valve may be provided that permits the hydraulic pumps to operate at a much lower pressure when tripped when the cover sections 24, 26 reach the open or closed positions. The pressure relief valve may have a pressure setting that is usually substantially higher than the highest pressure required by the circuit. All of the components in the circuit should have a pressure rating higher than the relief setting.

Due to the relatively small volume of oil flow in this system, the hydraulic system can safely run over a tripped relief for many minutes to accommodate the range of speed for a particular train. However, if the train were to stop for an extended period of time during the open/close cycle, the operator would need to de-energize the DC powered rails, which will result in turning off the hydraulic pump.

The train speed should not pose an issue at a rotary tipper unloading facility and can be set to optimize the cover systems performance. In certain embodiments, the entire train could have every cover open at a rotary tipper site before the rail car tipping process is begun.

The covers expose a large surface to the wind and should only be opened or closed if wind conditions are light to moderate unless moving of the covers between the opened and closed positions is done in a sheltered location.

With rotary tipper rail cars, the cover 10 must be opened before dumping the coal. In the open position, the cover 10 and hinge assemblies 30, 36 are substantially adjacent the top chord of the rail car. In this position, the rail car can be leaned up against the spill girder of the tipper, clamped down and rotated over to dump the coal without damaging any of the components of the cover system 10.

All of the weight of the rail car and the coal is compressing the hinge plates and the cover material under those plates. There will be no load transferred to the actual hinges or the hydraulic rotary actuators. This occurs because the hinge plates and covers are firmly clamped to the top chord before they are attached to the rail car.

With bottom dumping rail cars, the cover sections 24, 26 could remain in the closed position during the unloading process. If coal is dumped faster than air can leak into the rail car 22, the cover sections 24, 26 will flex downwardly until a gap forms in between them down the center of the rail car 22. This gap allows a sufficient volume of air to enter the rail car 22 to fill the void and relieve the vacuum left by the exiting coal without damaging either the rail car 22 or the rail car cover system 10. Thereafter, the cover sections 24, 26 will return to their original position.

The hydraulic actuators 70 may be connected using a coupling mechanism such as a quick disconnect coupler that enables the hydraulic actuator 70 to be disconnected to permit manual operation of the cover sections 24, 26. The rail car cover system 10 may also include locking mechanisms that retains the cover sections 24, 26 in the open configuration and/or the closed configuration. Such locking mechanisms may play an important role if it is necessary to disconnect the hydraulic actuators 70.

While it is generally desired to only position the cover sections 24, 26 in the open configuration for loading and/or unloading of the rail car 22, it is possible to position the cover sections 24, 26 in the open configuration when moving the rail car 22 for larger distances because the cover sections 24, 26 may be substantially parallel to sides of the rail car 22 when in the open configuration. As noted above, the hydraulic actuator 70 or the locking mechanisms could retain the cover sections 24, 26 in the open configuration.

Other possible methods for actuating the cover sections 24, 26 include vacuum suction cups that would lift part or all of the cover up and over from an onsite structure mounted apparatus. A helix shape spiral track could guide the leading edge of the covers up and over from the onsite structure mounted apparatus. An electromagnet lifting device could lift the leading end up and over from an onsite structure mounted apparatus. A vertical cam actuator at the hinge point could rotate the cover up and over from an onsite structure mounted apparatus.

In yet another configuration, an elevated surface is provided adjacent to the rail car 22. When an arm on the rail car 22 is urged upwards by the elevated surface, the mechanism to cause movement of the cover system 10 from the closed configuration to the open configuration is activated. During which time, the product may be placed in the rail car 22. Thereafter, when the elevated surface is discontinued, the cover system 10 may be caused to move from the open configuration to the closed configuration.

A variety of mechanisms may be used to cause the cover system 10 to move between the open and closed configurations, an example of which is a closed loop hydraulic system.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A vehicle cover system comprising:

a vehicle having an opening;

a first cover section operably attached to the vehicle, wherein the first cover section comprises a first corner hinge assembly, a first intermediate hinge assembly and a first cover material, wherein the first corner hinge assembly is attached to the first cover material and wherein the first intermediate hinge assembly is slidable with respect to the first cover material; and a second cover section operably attached to the vehicle, wherein the second cover section comprises a second corner hinge assembly, a second intermediate hinge assembly and a second cover material, wherein the second corner hinge assembly is attached to the second cover material, wherein the second intermediate hinge assembly is slidable with respect to the second cover material and wherein the first cover section and the second cover section are both movable between a closed configuration and an open configuration, when in the closed configuration, the first cover section and the second cover section substantially cover the opening.

2. The vehicle cover system of claim 1, wherein the first intermediate hinge assembly comprises:

a hinge mechanism;

a first elongated member attached to the hinge mechanism;

a second elongated member attached to the hinge mechanism; and a connector that operably attaches the first elongated member to the second elongated member.

3. The vehicle cover system of claim 2, wherein the connector is positioned on the first elongated member and the second elongated member spaced-apart from the hinge mechanism.

4. The vehicle cover system of claim 2, wherein the first elongated member and the second elongated member are fabricated from a flexible material.

5. The vehicle cover system of claim 2, wherein the first cover material has an aperture formed therein, wherein a portion of the first cover material is positioned between the first elongated member and the second elongated member and wherein the connector extends through the aperture in the first cover material.

6. The vehicle cover system of claim 2, wherein the connector is slidably mounted with respect to the first elongated member and the second elongated member.

7. The vehicle cover system of claim 2, wherein the connector is a sleeve that extends at least partially around the first elongated member and the second elongated member.

8. The vehicle cover system of claim 1, wherein the first intermediate hinge assembly and the second intermediate hinge assembly each have a convex configuration.

9. The vehicle cover system of claim 1, wherein the first corner hinge assembly and the first intermediate hinge assembly are independently operable so that the first cover section does not remain flat when moving between the closed configuration and the open configuration and wherein the second corner hinge assembly and the second intermediate hinge assembly are independently operable so that the second cover section does not remain flat when moving between the closed configuration and the open configuration.

10. The vehicle cover system of claim 1, wherein the vehicle comprises a first side, a second side, a first end, a second end and a bottom that are operably connected to define an enclosure with an upwardly directed opening, wherein the first cover section is operably attached to the first side, wherein the second cover section is operably attached to the second side and wherein the first cover section and the second cover section are substantially parallel to the first side and the second side when in the open configuration.

11. The vehicle cover system of claim 1, wherein the first corner hinge assembly and second corner hinge assembly each comprise a hinge and an elongated member that is attached to and extends from the hinge.

12. The vehicle cover system of claim 1, and further comprising a mechanical assist to move the first cover section and the second cover section between the open configuration and the closed configuration.

13. The vehicle cover system of claim 12, wherein the mechanical assist is a hydraulic actuator and wherein operation of the hydraulic actuator is controlled with a hydraulic pump.

14. The vehicle cover system of claim 13, wherein the hydraulic actuator includes a counterbalance valve to maintain the first cover section and the second cover section in the closed configuration when the hydraulic actuator is not actuated.

15. The vehicle cover system of claim 12, and further comprising at least one contact paddle mounted with respect to the vehicle, wherein the at least one contact paddle is operably connected to the mechanical assist to control operation of the mechanical assist and wherein the at least one contact paddle is mounted on at least one side of the vehicle.

16. The vehicle cover system of claim 12, wherein the first cover material and the second cover material each have a proximal edge and a distal edge, wherein the mechanical assist is mounted in at least one location along the proximal edge.

17. The vehicle cover system of claim 1, wherein at least one of the first cover material and the second cover material are fabricated from a flexible material.

18. The vehicle cover system of claim 1, wherein the vehicle is a rail car.

19. A method of covering a vehicle comprising:

providing a vehicle having an opening;

attaching a first cover section to the vehicle, wherein the first cover section comprises a first corner hinge assembly, a first intermediate hinge assembly and a first cover material, wherein the first corner hinge assembly is attached to the first cover material and wherein the first intermediate hinge assembly is slidable with respect to the first cover material;

attaching a second cover section to the vehicle, wherein the second cover section comprises a second corner hinge assembly, a second intermediate hinge assembly and a second cover material and wherein the second corner hinge assembly is attached to the second cover material and wherein the second intermediate hinge assembly is slidable with respect to the second cover material; and moving the first cover section and the second cover section between a closed configuration and an open configuration, when in the closed configuration, the first cover section and the second cover section substantially cover the opening.

20. The method of claim 19, wherein the first corner hinge assembly and the first intermediate hinge assembly are independently operable so that the first cover section does not remain flat when moving between the closed configuration and the open configuration and wherein the second corner hinge assembly and the second intermediate hinge assembly are independently operable so that the second cover section does not remain flat when moving between the closed configuration and the open configuration.

21. The method of claim 19, wherein the product is unloaded from the vehicle with the first cover section and the second cover section in the closed configuration, wherein at least one of the first cover section and the second cover section deflect as the product is unloaded from the vehicle.

22. The method of claim 19, wherein moving the first cover section and the second cover section between the open position and the closed position is done with a mechanical assist selected from the group consisting of hydraulic, vacuum, electromagnet, a vertical cam actuator and combinations thereof.

23. The method of claim 22, wherein the mechanical assist is activated sufficiently long so that the first cover section and the second cover section move substantially between the closed configuration and the open configuration.

24. The method of claim 19, and further comprising fabricating at least one of the first cover material and the second cover material from a flexible material.

* * * * *